US010992059B2

(12) United States Patent
Zhu et al.

(10) Patent No.: US 10,992,059 B2
(45) Date of Patent: Apr. 27, 2021

(54) MILLIMETER WAVE ARRAY ANTENNA MODULE AND MOBILE TERMINAL

(71) Applicant: AAC Technologies Pte. Ltd., Singapore (SG)

(72) Inventors: Zhimin Zhu, Shenzhen (CN); Zhengdong Yong, Shenzhen (CN); Xiaoyue Xia, Shenzhen (CN); Chao Wang, Shenzhen (CN)

(73) Assignee: AAC Technologies Pte. Ltd., Singapore (SG)

( * ) Notice: Subject to any disclaimer, the term of this patent is extended or adjusted under 35 U.S.C. 154(b) by 0 days.

(21) Appl. No.: 16/706,880

(22) Filed: Dec. 9, 2019

(65) Prior Publication Data

US 2020/0350696 A1 Nov. 5, 2020

(30) Foreign Application Priority Data

Dec. 29, 2018 (CN) ..... 201811641112.X

(51) Int. Cl.
*H01Q 21/08* (2006.01)
*H01Q 1/22* (2006.01)
(Continued)

(52) U.S. Cl.
CPC ..... *H01Q 21/08* (2013.01); *H01Q 1/2283* (2013.01); *H01Q 1/243* (2013.01); *H01Q 3/38* (2013.01); *H01Q 9/0407* (2013.01)

(58) Field of Classification Search
CPC ..... H01Q 21/08; H01Q 1/2283; H01Q 1/243; H01Q 3/38; H01Q 9/0407
(Continued)

(56) References Cited

U.S. PATENT DOCUMENTS 8,354,972 B2 * 1/2013 Borja ..... H01Q 5/378 343/797
9,136,576 B2 * 9/2015 Hashimoto ..... H01P 5/107
(Continued)

FOREIGN PATENT DOCUMENTS

CN 106898882 A1 6/2017
CN 109103589 A1 12/2018
CN 109687165 A1 4/2019

OTHER PUBLICATIONS

1st Office Action dated Mar. 25, 2020 by SIPO in related Chinese Patent Application No. 201811641112.X (7 Pages).
(Continued)

*Primary Examiner* — Hai V Nguyen
(74) *Attorney, Agent, or Firm* — W&G Law Group LLP

(57) ABSTRACT

A millimeter wave array antenna module and a mobile terminal are provided. The millimeter wave array antenna module includes a dielectric substrate, a radio frequency integrated circuit chip affixed to one side of the dielectric substrate, a plurality of antenna units arranged in an array and disposed on a side of the dielectric substrate facing away from the radio frequency integrated circuit chip, and a feeding network formed in the dielectric substrate. Each antenna unit is electrically connected to the radio frequency integrated circuit chip through the feeding network, and includes a substrate integrated waveguide and a patch antenna. The substrate integrated waveguide has a back cavity and the patch antenna is arranged in the back cavity and affixed to the substrate integrated waveguide.

11 Claims, 3 Drawing Sheets

(51) Int. Cl.
*H01Q 1/24* (2006.01)
*H01Q 3/38* (2006.01)
*H01Q 9/04* (2006.01)

(58) Field of Classification Search
USPC ..... 455/575.7; 343/777, 893
See application file for complete search history.

(56) References Cited

U.S. PATENT DOCUMENTS

| | | | | |
|---|---|---|---|---|
| 9,748,648 | B2 * | 8/2017 | Caille | H01Q 3/40 |
| 9,912,072 | B1 * | 3/2018 | Mandeville | H01Q 21/064 |
| 10,468,779 | B2 * | 11/2019 | Mandeville | H01Q 21/064 |
| 10,637,159 | B2 * | 4/2020 | Yoon | H01Q 21/24 |
| 2012/0050131 | A1 * | 3/2012 | Hashimoto | H01P 1/042 343/878 |
| 2013/0016023 | A1 * | 1/2013 | Gaucher | H01Q 19/30 343/824 |
| 2014/0320345 | A1 * | 10/2014 | Caille | H01Q 3/40 342/373 |
| 2016/0028162 | A1 | 1/2016 | Ou et al. | |
| 2018/0198215 | A1 * | 7/2018 | Mandeville | H01Q 21/0087 |
| 2019/0267716 | A1 * | 8/2019 | Yoon | H01Q 21/245 |
| 2019/0267721 | A1 * | 8/2019 | Yoon | H01Q 13/20 |
| 2019/0267722 | A1 * | 8/2019 | Yoon | H01Q 1/523 |
| 2019/0312334 | A1 * | 10/2019 | Shin | H04M 1/0249 |
| 2019/0334249 | A1 * | 10/2019 | Smith | H01R 12/7076 |

OTHER PUBLICATIONS

PCT search report dated Jan. 23, 2020 by SIPO in related PCT Patent Application No. PCT/CN2019/113358 (4 Pages).

* cited by examiner

MILLIMETER WAVE ARRAY ANTENNA MODULE AND MOBILE TERMINAL

TECHNICAL FIELD

The present invention relates to the field of antenna structure technologies of mobile terminals, and in particular, to a millimeter wave array antenna module and a mobile terminal.

BACKGROUND

With 5G being the focus of research and development in the global industry, developing 5G technologies and formulating 5G standards have become the industry consensus. The ITU-RWP5D 22nd meeting held in June 2015 by International Telecommunication Union (ITU) identified three main application scenarios for 5G: enhance mobile broadband, large-scale machine communication, and highly reliable low-latency communication. These three application scenarios respectively correspond to different key indicators, and in the enhance mobile broadband scenario, the user peak speed is 20 Gbps and the minimum user experience rate is 100 Mbps. 3GPP is working on standardization of 5G technology. The first 5G Non-Stand Alone (NSA) international standard was officially completed and frozen in December 2017, and the 5G Stand Alone standard was scheduled to be completed in June 2018. Research work on many key technologies and system architectures during the 3GPP conference was quickly focused, including the millimeter wave technology. The high carrier frequency and large bandwidth unique to the millimeter wave are the main means to achieve 5G ultra-high data transmission rates.

The rich bandwidth resources of the millimeter wave band provide a guarantee for high-speed transmission rates. However, due to the severe spatial loss of electromagnetic waves in this frequency band, wireless communication systems using the millimeter wave band need to adopt an architecture of a phased array. The phases of respective array elements are distribute with a regularity through a phase shifter, so that a high gain beam is formed and the beam scans over a certain spatial range through a change in phase shift.

With an antenna being an indispensable component in a radio frequency (RF) front-end system, it is an inevitable trend in the future to system-integrate and package the antenna with a RF front-end circuit while developing the RF circuit towards the direction of integration and miniaturization. The antenna-in-package (AiP) technology integrates, through package material and process, the antenna into a package carrying a chip, which fully balances the antenna performance, cost and volume and is widely favored by broad chip and package manufacturers. Companies including Qualcomm, Intel, IBM and the like have adopted the antenna-in-package technology. Undoubtedly, the AiP technology will also provide a good antenna solution for mobile communication systems using 5G millimeter wave.

When the millimeter wave phased array antenna scans to a relatively large angle, influence of surface waves, to which it is subjected, will become more prominent, which will cause a relatively large attenuation of a gain in a maximum radiation direction of the antenna, thus affecting an overall performance of the millimeter wave phased array antenna.

BRIEF DESCRIPTION OF DRAWINGS

Many aspects of the exemplary embodiment can be better understood with reference to the following drawings. The components in the drawings are not necessarily drawn to scale, the emphasis instead being placed upon clearly illustrating the principles of the present invention. Moreover, in the drawings, like reference numerals designate corresponding parts throughout the several views.

DESCRIPTION OF EMBODIMENTS

The present invention will be further illustrated with reference to the accompanying drawings and the embodiments.

Figure 1:
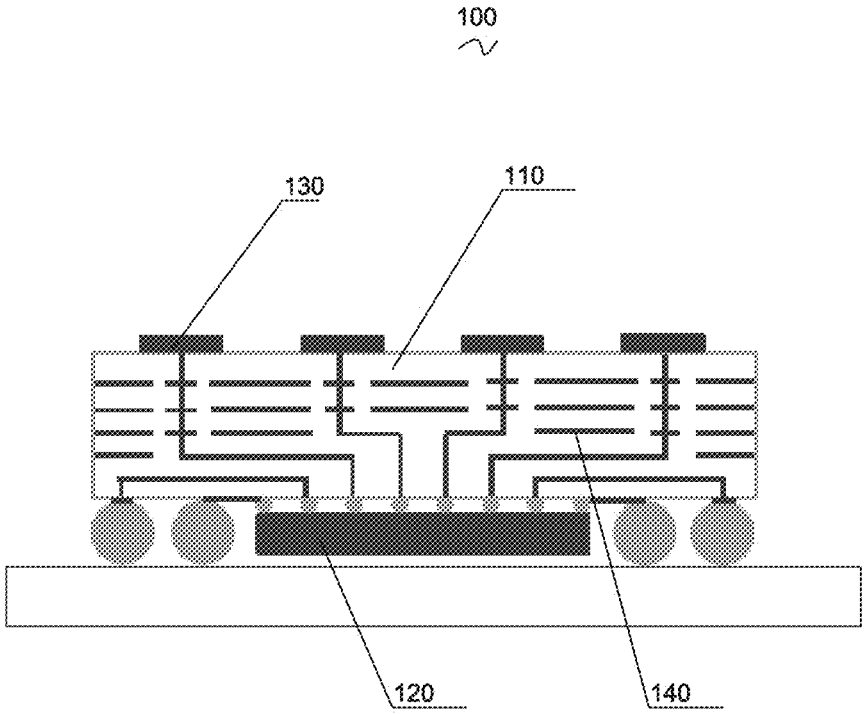
FIG. 1 is a schematic diagram of a millimeter wave array antenna module.
Figure 2:
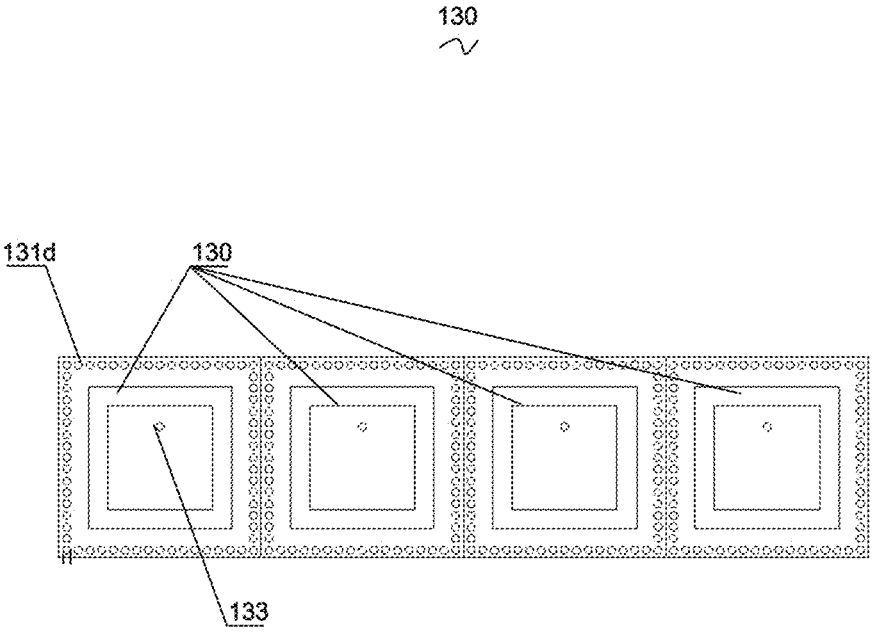
FIG. 2 is a schematic diagram of an antenna unit in a millimeter wave array antenna module.

A first aspect of the present invention relates to a millimeter wave array antenna module 100 applied in a mobile terminal. The mobile terminal can be, for example, a mobile phone, a computer, or a tablet. As shown in FIG. 1 and FIG. 2, the millimeter wave array antenna module 100 includes a dielectric substrate 110, a radio frequency integrated circuit chip 120 attached to one side of the dielectric substrate 110, multiple antenna units 130 arranged in an array and disposed on one side of the dielectric substrate 110 facing away from the radio frequency integrated circuit chip, and a feeding network 140 formed in the dielectric substrate 110. Each antenna unit 130 is electrically connected to the radio frequency integrated circuit chip 120 through the feeding network 140. Each antenna unit 130 includes a substrate integrated waveguide 131 and a patch antenna 132, the substrate integrated waveguide 131 includes a back cavity, and the patch antenna 132 is attached to the substrate integrated waveguide corresponding to the back cavity.

In the millimeter wave array antenna module 100 in this embodiment, each antenna unit 130 thereof is electrically connected to the radio frequency integrated circuit chip 120 through the feeding network 140, and each antenna unit 130 includes the substrate integrated waveguide 131 having a back cavity and the patch antenna 132 attached to the back cavity. Employing a structure in which the patch antenna is arranged in the back cavity of the substrate integrated waveguide, can effectively reduce a surface wave because the back cavity of the substrate integrated waveguide 131 can effectively suppress a propagation of the surface wave. Therefore, when the millimeter wave array antenna module 100 scans to a large angle, attenuation of an antenna gain can be significantly suppressed, so that the phased array antenna can obtain a larger scanning angle, and thus the antenna performance in the case of large angle scanning can be improved.

It should be understood that the specific number of the antenna units 130 included in the millimeter wave array antenna module 100 is not limited. For example, as shown in FIG. 2, the millimeter wave array antenna module 100 can include four antenna units 130, and the four antenna units 130 can be arranged in a 1*4 array. Besides this configuration, those skilled in the art can determine other numbers and arrangements of the antenna units 130 according to actual needs.

Figure 3:
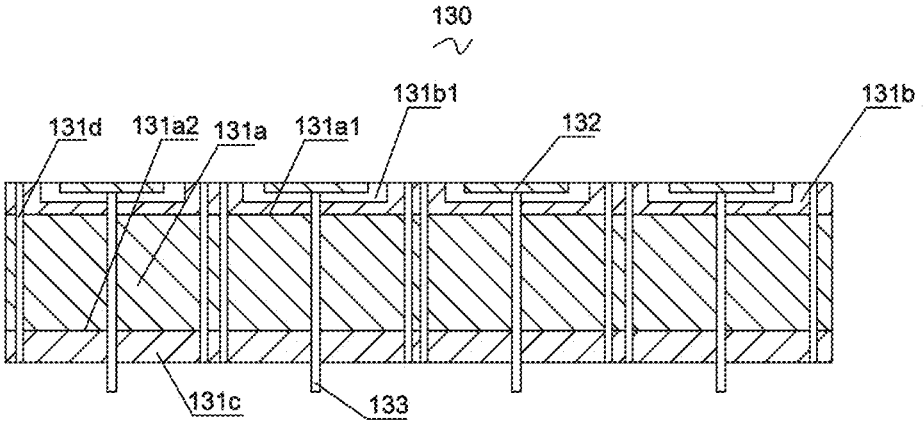
FIG. 3 is a cross-sectional diagram of the antenna unit in the millimeter wave array antenna module shown in FIG. 2.

As shown in FIG. 3, the substrate integrated waveguide 131 includes a dielectric plate 131*a*. The dielectric plate 131*a* includes a first surface 131*a*1 and a second surface 131*a*2 that are opposite to each other in a thickness direction of the dielectric plate 131*a*. The substrate integrated waveguide 131 further includes a first metal layer 131*b* attached to the first surface 131*a*1, a second metal layer 131*c* attached to the second surface 131*a*2, and multiple metal vias 131*d* provided on a periphery of the dielectric plate 131*a* and spaced apart from each other. Each metal via 131*d* communicates the first metal layer 131*b* with the second metal layer 131*c*. The first metal layer 131*b*, the second metal layer 131*c*, and the metal vias 131*d* are cooperated with each other to form the back cavity.

As shown in FIG. 3, a radiation window 131*b*1 is provided in a center of the first metal layer 131*b*. The patch antenna 132 is received in the radiation window 131*b*1 and is spaced apart from the first metal layer 131*b*. Each antenna unit 130 further includes a feeding probe 133. The feeding probe 133 includes a first end electrically connected to the patch antenna 132 and a second end penetrating the second surface 131*a*2 to be connected to the feeding network 140.

As shown in FIG. 1, the radio frequency integrated circuit chip 120 includes multiple channels. Each channel includes at least one phase shifter (not shown), and each antenna unit 130 is electrically connected to an input terminal of the phase shifter via the feeding network 140.

It should be noted that there is no limitation on a specific structure of the phase shifter. For example, the phase shifter can be a five-bit digit phase shifter. In addition, the phase shifter can also be other types of phase shifters, which can be determined according to actual needs.

Optionally, the phase shifter has a phase shift accuracy of 11.25°. However, the present invention is not limited thereto, and those skilled in the art can, according to actual needs, determine the specific phase shift accuracy range required.

The millimeter wave array antenna module 100 of the present invention is a linear array instead of a planar array. Thus, one the one hand, a space occupied by the millimeter wave array module 100 in the mobile phone can be narrowed, and only one angle is scanned to, which simplifies design difficulty, test difficulty, and beam management complexity. On the another hand, due to a symmetry structure of the antenna unit 130, it is easy to satisfy a dual polarization requirement. In addition, employing the structure in which patch antenna is arranged in the back cavity of the substrate integrated waveguide, can effectively suppress the gain attenuation in the case of large angle scanning, so that the millimeter wave array antenna 100 can obtain a larger scanning angle. For the case of 50% coverage, compared with a peak gain, it is dropped by 9.5 dB, which is superior to the case of adopting a common patch antenna in which it is dropped by 11 dB, and the requirement that the drop does not exceed 12.98 dB in the 3GPP discussion is also satisfied.

It should be noted that a form and a type of the patch antenna arranged in the back cavity of the substrate integrated waveguide are not limited and are not limited to an antenna arranged in the back cavity of the substrate integrated waveguide in the present invention, the antenna employing probe feeding and in a rectangular patch form. Adopting other forms of patches, such as square, circular, and cross-shaped ones, and adopting other forms of feeding, such as microstrip feeding and slot coupling, can all be used as antenna forms of the present invention.

A second aspect of the present invention provides a mobile terminal, and the mobile terminal includes the millimeter wave array antenna module 100 described above.

The mobile terminal in this embodiment has the millimeter wave array antenna module 100 described above, and each antenna unit 130 is electrically connected to the radio frequency integrated circuit chip 120 through the feeding network 140, and each antenna unit 130 includes the substrate integrated waveguide 131 having a back cavity and the patch antenna 132 attached to the back cavity. Adopting the structure of the patch antenna arranged in the back cavity of the substrate integrated waveguide can effectively reduce the surface wave because the back cavity on the substrate integrated waveguide 131 can effectively suppress the propagation of the surface wave. Therefore, when the millimeter wave array antenna module 100 scans to a large angle, attenuation of an antenna gain can be significantly suppressed, so that the phased array antenna can obtain a larger scanning angle, and thus the antenna performance in the case of large angle scanning can be improved.

What has been described above is only some embodiments of the present invention, and it should be noted herein that one ordinary person skilled in the art can make modifications without departing from the inventive concept of the present invention, and modifications are all within the scope of the present invention.

What is claimed is:

1. A millimeter wave array antenna module, comprising:

a dielectric substrate;

a radio frequency integrated circuit chip attached to one side of the dielectric substrate;

a plurality of antenna units arranged in an array and disposed on a side of the dielectric substrate facing away from the radio frequency integrated circuit chip; and a feeding network formed in the dielectric substrate, wherein each of the plurality of antenna units is electrically connected to the radio frequency integrated circuit chip through the feeding network, and comprises a substrate integrated waveguide and a patch antenna, wherein the substrate integrated waveguide comprises a back cavity and the patch antenna is attached to the substrate integrated waveguide corresponding to the back cavity;

the substrate integrated waveguide comprises:

a dielectric plate comprising a first surface and a second surface that are opposite to each other in a thickness direction of the dielectric plate;

a first metal layer attached to the first surface;

a second metal layer attached to the second surface; and a plurality of metal vias provided on a periphery of the dielectric plate and spaced apart from each other, wherein each of the plurality of metal vias communicates the first metal layer with the second metal layer, and the first metal layer, the second metal layer and the plurality of metal vias are cooperated with each other to form the back cavity.

2. The millimeter wave array antenna module as described in claim 1, wherein a radiation window is opened in a center of the first metal layer; the patch antenna is received in the radiation window and is spaced apart from the first metal layer; and each of the plurality of antenna units further comprises a feeding probe, and the feeding probe comprises a first end electrically connected to the patch antenna and a second end penetrating the second surface to be connected to the feeding network.

3. The millimeter wave array antenna module as described in claim 2, wherein the radio frequency integrated circuit chip comprises a plurality of channels, wherein each of the plurality of channels comprises at least one phase shifter, and each of the plurality of antenna units is electrically connected to an input terminal of one of the at least one phase shifter via the feeding network.

4. The millimeter wave array antenna module as described in claim 2, wherein the plurality of antenna units comprises four antenna units arranged in a 1*4 array.

5. The millimeter wave array antenna module as described in claim 1, wherein the radio frequency integrated circuit chip comprises a plurality of channels, wherein each of the plurality of channels comprises at least one phase shifter, and each of the plurality of antenna units is electrically connected to an input terminal of one of the at least one phase shifter via the feeding network.

6. The millimeter wave array antenna module as described in claim 5, wherein one of the at least one phase shifter is a five-bit digit phase shifter.

7. The millimeter wave array antenna module as described in claim 5, wherein the phase shifter has a phase shift accuracy of 11.25°.

8. The millimeter wave array antenna module as described in claim 1, wherein the radio frequency integrated circuit chip comprises a plurality of channels, wherein each of the plurality of channels comprises at least one phase shifter, and each of the plurality of antenna units is electrically connected to an input terminal of one of the at least one phase shifter via the feeding network.

9. The millimeter wave array antenna module as described in claim 1, wherein the plurality of antenna units comprises four antenna units arranged in a 1*4 array.

10. The millimeter wave array antenna module as described in claim 1, wherein the plurality of antenna units comprises four antenna units arranged in a 1*4 array.

11. A mobile terminal, comprising the millimeter wave array antenna module as described in claim 1.

* * * * *